United States Patent [19]

Lueschen

[11] Patent Number: 5,009,623

[45] Date of Patent: Apr. 23, 1991

[54] SURFING SAUCER

[76] Inventor: Jeffrey D. Lueschen, 2335 #23 Caringa Way, Carlsbad, Calif. 92009

[21] Appl. No.: 481,590

[22] Filed: Feb. 20, 1990

[51] Int. Cl.[5] ..... A63B 31/10

[52] U.S. Cl. ..... 441/56; 441/58

[58] Field of Search ..... 441/55, 56, 57, 58; D21/236, 237, 238, 239

[56] References Cited

U.S. PATENT DOCUMENTS 2,290,943 7/1942 Conley ..... 441/58
2,313,979 3/1943 Tuma ..... 441/58
2,810,138 10/1957 Cochran ..... 441/58
3,359,678 12/1967 Headrick ..... 46/74

FOREIGN PATENT DOCUMENTS 97264 12/1922 Switzerland ..... 441/58

*Primary Examiner*—Sherman Basinger
*Assistant Examiner*—Stephen P. Avila

[57] ABSTRACT

A propulsion device, the device having a saucer shaped hydroplane connected to a strap. The strap affixes the swimmer's hand to the saucer. When the swimmer engages a wave, the device provides a lifting force allowing the swimmer to hydroplane on the face of the wave.

1 Claim, 2 Drawing Sheets

SURFING SAUCER

BACKGROUND

1. Field of Invention

This invention relates to a propulsion device, specifically to a saucer affixed to the hand of a swimmer to affect hydroplaning.

2. Description of Prior Art

Surfing has its roots in the Polynesian culture. Hawaiian legends dating back to the fifteenth century are the earliest known documentation of the sport.

The early implements of surfing consisted of massive 10–16 foot long wooden planks. In recent years various devices have been implemented to assist the user in the sport of surfing. Surfboards, knee boards, and body boards (best known as BOOGIE® boards owned by Morey Boogie) are the most common of these devices.

All these devices hydroplane or surf effectively but they tend to be bulky. The bulkiness of these devices creates difficulties in transporting them to and from the beach. Additionally, this bulk makes diving under waves and maintaining possession of the device in turbulent water conditions difficult for the user.

Surfboards, knee boards, and body boards require substantial material, and labor to manufacture. As a result these devices are expensive to buy. High equipment cost, along with being difficult to transport, discourage many people from acquiring these devices and participating in the sport.

Body boards are constructed out of a soft semi-rigid material. They are normally used without skegs. Semi-rigid construction and lack of sharp appendages make the body board very "user friendly" and highly popular. The rigid construction and sharp skegs of surfboards and knee boards can cause them to become dangerous projectiles in crowded surf conditions. Use of these devices in shallow breaking surf exposes the surfer to the risk of impalement by the device.

A more obscure type of surfing implement is called a hand plane. A hand plane is a hand held hydroplaning device. Present state of the art designs are shaped to resemble miniature surfboards. Slots, grips, and straps, as means for affixing the hand to the hand plane, are all commonly employed. These devices are highly portable and inexpensive but are not popular because of their marginal performance. It is thought that this marginal performance is due to their large length to width ratio.

The length to width ratio of surfboards, knee boards, and body boards decreases as the overall length decreases. Surfboards have a length to width ratio of 5:1 to 4:1. Knee boards and body boards, which are nearly half the length of surfboards, have a length to width ratio closer to 2:1. Following this trend, the length to width ratio of a surfing implement as short as a hand plane should approach 1:1.

Saucers have length to width ratio of 1:1. The excellent aerodynamic properties of saucers is well known. U.S. Pat. No. 3,359,678 to E. Headrick assigned to Wham-o Manufacturing Company of Dec. 26, 1967 describes a saucer shaped throwing implement now known as a Frisbee®. The Frisbee® is a flying saucer with the improved aerodynamic feature of "spoilers". Circular ridges circumscribing the periphery on the convex side of the saucer "spoil" the air flow. "Spoiling" the air flow is thought to create a turbulent unseparated boundary layer over the convex side of the saucer. Creation of a turbulent boundary layer results in a reduction of drag through the air. Air and water are both classified as fluids. With respect to this concept, it may be postulated that the hydrodynamic and aerodynamic properties of saucers have some commonality.

OBJECTS AND ADVANTAGES

It is an object of this invention to provide a saucer shaped surfing implement that is portable, inexpensive, safe, and creates minimal drag. Other and additional objectives will become apparent upon a reading of the entire specification, including the drawings and claims.

Several objects and advantages of the present invention are;

(a) to provide a surfing implement which is easily portable to and from the beach.

(b) to provide an inexpensive surfing implement which requires minimal material and labor to manufacture.

(c) to provide a surfing implement of semi-rigid construction and devoid of sharp geometries that could cause injury to the user.

(d) to provide a surfing implement which, due to its small size, allows easy submersion under waves when desired and easy possession in turbulent water conditions.

(e) to provide a surfing implement that reduces fluid drag by "spoiling" the fluid flow to create a turbulent boundary layer on which it rides.

Further objects and advantages will become apparent upon a reading of the entire specification, including the drawing and claims.

DRAWING FIGURES

REFERENCE NUMERALS IN DRAWINGS

Figure 1:
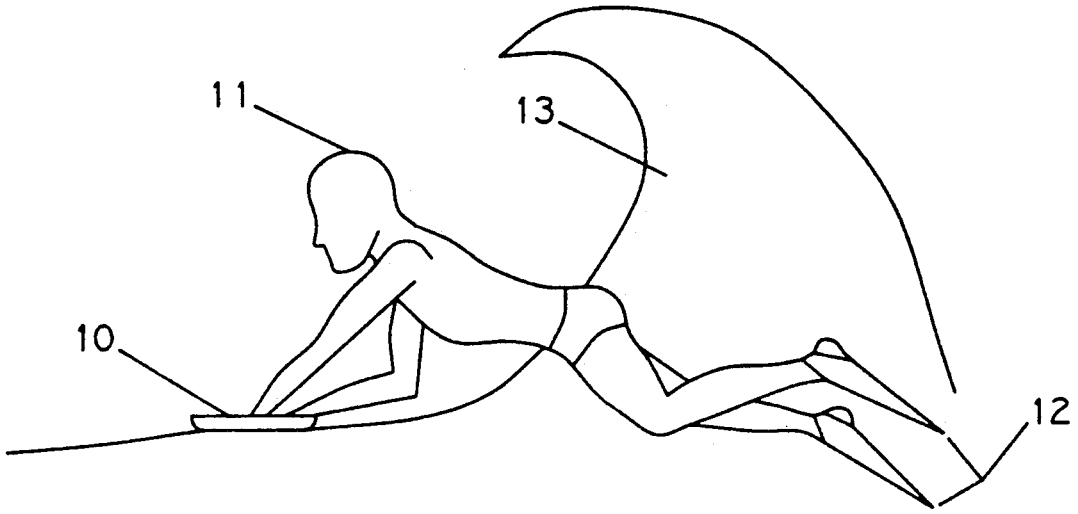
FIG. 1 is a pictorial view of the present invention in use by a swimmer surfing on a wave.

10 surfing saucer assembly
11 swimmer
12 swim fins
13 wave
20 strap
30 buckles
40 fasteners
50 plastic saucer
60 flat central circular area
70 rim
80 surface of curvature
90 concentric circular ridges

Figure 3:
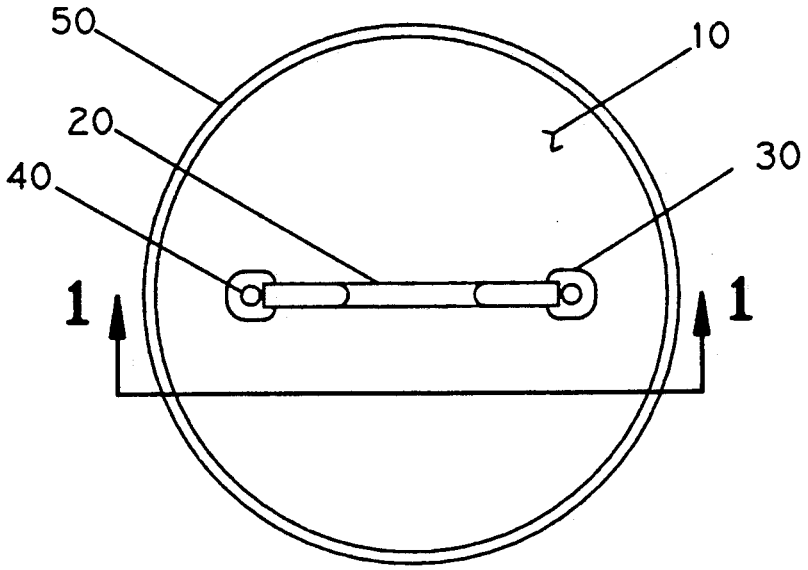
FIG. 3 is a plan view of the present invention.
Figure 4:
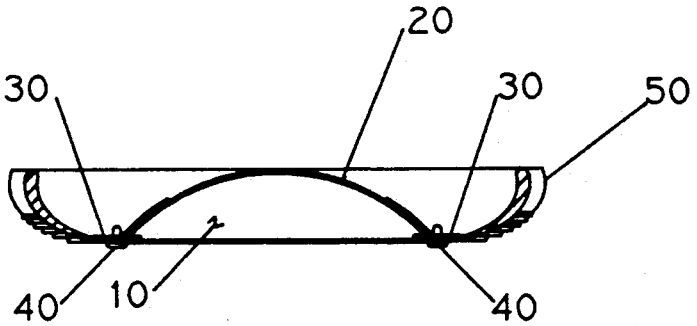
FIG. 4 is an elevation view of the present invention.
Figure 5:
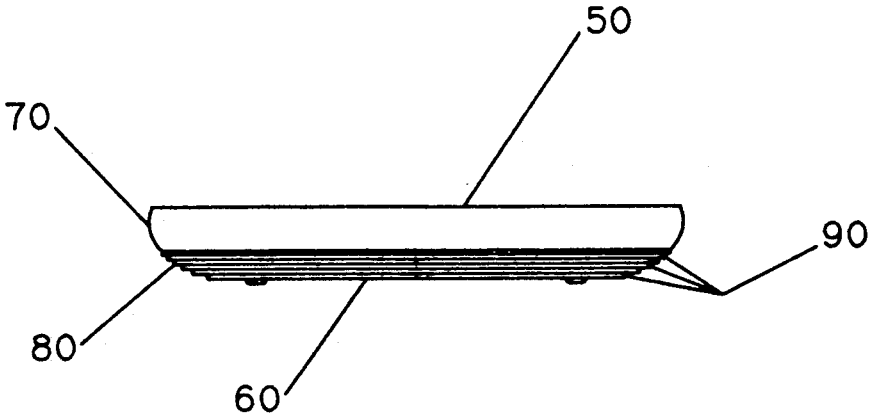
FIG. 5 is an elevation view of the present invention depicting the external features of the saucer.

DESCRIPTION—FIGS. 3 to 5

A typical embodiment of the present invention 10 is shown in FIG. 3 (plan view) and FIGS. 4 and 5 (elevation views). The plastic saucer 50 having a substantially flat central circular area 60 is circumscribed by a rim 70. A surface of curvature 80 connects the rim 70 to the flat central circular area 60. As can be observed from FIG. 5 a plurality of "spoiling" circular ridges 90 are positioned upon the surface of curvature 80. Passing through the plastic saucer 50, as shown in FIG. 4, is a pair of fasteners 40. The pair of fasteners 40 attach a pair of buckles 30 to the plastic saucer 50. FIG. 3 shows the strap 20 bisecting the central circular area 60 of the plastic saucer 50. The strap 20 is firmly connected at each end to a buckle 30.

From the description above, several advantages of my saucer surfing implement become evident:

(a) Minimal amounts of material and assembly are required to achieve the preferred embodiment of the surfing implement. All features and elements are easily mass produced reducing component cost.

(b) The plastic construction and smooth features of the surfing saucer assembly minimizes the risk of user injury.

OPERATION—FIGS. 1,2

Figure 2:
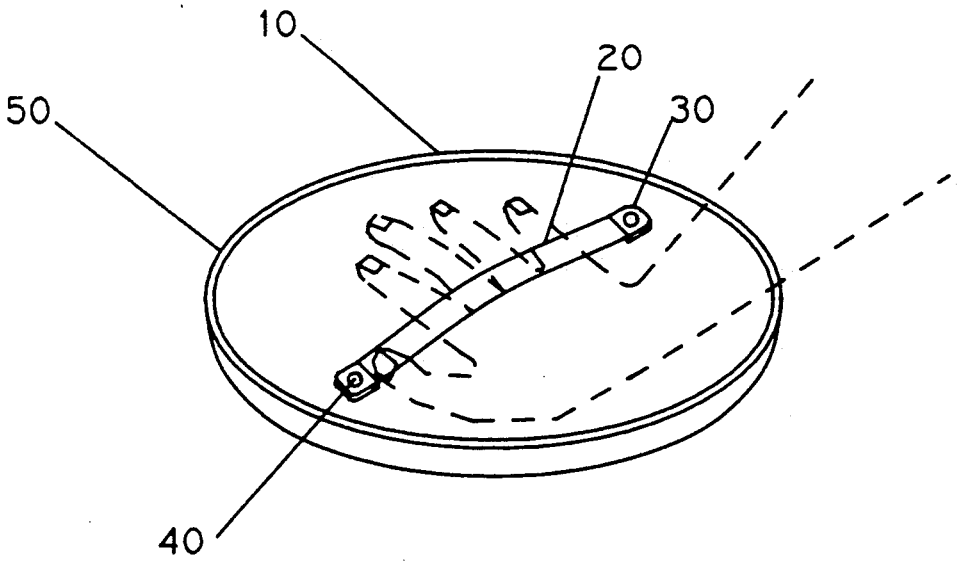
FIG. 2 is a perspective view of the present invention.

The manner of using the surfing saucer is illustrated in FIGS. 1 and 2. Arms of the swimmer are extended, with one hand engaged with the surfing saucer strap 20, as the wave 13 approaches. The swimmer 11 kicks with his feet and optional swim fins 12 to catch the wave 13. As the wave 13 crests and begins to break, the surfing saucer 10 lifts hydrodynamically. The ridges 90 on the plastic saucer 50 "spoil" the hydraulic flow to create a turbulent boundary layer on the bottom of the plastic saucer 50. This turbulent boundary layer significantly reduces the fluid drag and the surfing saucer begins to hydroplane. The hydroplaning of the surfing disk 10 lifts the torso of the swimmer 11 up and out of the water. This action further reduces the fluid drag of the swimmer 11 thereby increasing the swimmer's speed. The increased swimmer's velocity and lift from the surfing saucer causes the entire body to hydroplane or surf.

SUMMARY, RAMIFICATIONS, AND SCOPE

Accordingly, the reader will see that the surfing saucer can be used by a swimmer to hydroplane or surf on a wave. The surfing saucer has the additional advantages in that it provides a compact and easily portable surfing implement;

it provides a surfing implement of low volume and surface area which allows easy submersion under incoming waves and easy retention in turbulent water conditions;

it provides a surfing implement in which minimal amounts of material and labor are required to produce the item;

it provides a surfing implement of semi-rigid construction and smooth geometries that minimize the risk of injury to the user;

it provides a surfing implement that reduces fluid drag by "spoiling" the hydraulic flow to create a turbulent boundary layer on which it rides.

It will be recognized that modifications may be made within the scope of the invention, and this invention is not restricted to the preferred embodiment illustrated. For example, the strap, buckles, and fasteners may be integrated into one piece; the "spoiling" effect caused by the circular ridges circumscribing the periphery on the convex side of the saucer may be caused by other geometries placed in the same location.

The scope of the invention should be determined by the appended claims and their legal equivalents, rather than by the examples given.

I claim:

1. A marine propulsion device comprising:

(a) a saucer having a substantially flat circular area circumscribed by a rim with a surface of convex curvature connecting said central circular area to said rim to form concave and convex saucer sides;

(b) a hand strap bisecting said central circular area of said saucer which is firmly connected at both ends to the concave side of the saucer;

(c) the saucer having hydraulic flow spoiling means located on the convex surface of curvature; and, (d) said hydraulic spoiling means being further defined as comprising a plurality of evenly spaced circular ridges concentric to the center of the saucer.

* * * * *